US005983422A

United States Patent [19]

Bayless

[11] Patent Number: 5,983,422

[45] Date of Patent: Nov. 16, 1999

[54] COLLAPSIBLE HAMMOCK

[76] Inventor: Lee Bayless, 27526 Wellsley Way, Valencia, Calif. 91354

[21] Appl. No.: 09/048,961

[22] Filed: Mar. 26, 1998

[51] Int. Cl.[6] ..... A45F 3/24

[52] U.S. Cl. ..... 5/120; 5/129; 5/127; 5/128

[58] Field of Search ..... 5/120, 122, 123, 5/127, 128, 129; 248/166, 171; 403/171, 176

[56] References Cited

U.S. PATENT DOCUMENTS

| | | | |
|---|---|---|---|
| 381,025 | 4/1888 | Parmelle | 5/129 |
| 531,727 | 1/1895 | Keegan et al. | 5/129 |
| 935,445 | 9/1909 | Wolf | 5/121 |
| 1,229,537 | 6/1917 | Sisbower et al. | 5/127 |
| 2,563,156 | 8/1951 | Carl | 5/129 |
| 4,797,961 | 1/1989 | Pasquariello | 5/122 |
| 5,003,652 | 4/1991 | Bayless | 5/122 |
| 5,392,476 | 2/1995 | Williams | 5/127 |
| 5,659,907 | 8/1997 | Huang | 5/120 |

*Primary Examiner*—Michael F. Trettel
*Assistant Examiner*—Fredrick Conley
*Attorney, Agent, or Firm*—James E. Brunton

[57] ABSTRACT

A collapsible, self-supporting, fully portable hammock assembly in which the supporting framework is fabricated of lightweight metal components. The apparatus can be quickly and easily extended from a compact, collapsible configuration into a self-supporting highly stable structure which safely carries the hammock. The supporting framework includes a pair of hammock support uprights which are pivotally connected to novel mounting brackets which also support pairs of transversely extending ground engaging stabilizing members.

20 Claims, 6 Drawing Sheets

-54-
10
10

COLLAPSIBLE HAMMOCK

BACKGROUND OF THE INVENTION

1. Field of the Invention

The present invention relates generally to hammocks. More particularly, the invention concerns an improved, lightweight, collapsible, easily portable hammock for use indoors and outdoors.

2. Discussion of the Invention

Hammocks have been known for many, many years, and have been widely used for both recreational and utilitarian purposes. Because of the recreational popularity of hammocks, numerous types of foldable hammock supporting structures for holding the hammock in an outstretched position have been suggested. However, such foldable or collapsible hammock supports are typically complex in construction and are often unwieldy and difficult to use. Further, such structures are generally heavy, quite bulky when in a collapsed or folded configuration, and accordingly, are extremely difficult to transport from place to place.

One of the most successful prior art collapsible hammocks is that described in U.S. Pat. No. 5,003,652 issued to the present inventor. The present invention comprises an improvement to the construction described in this earlier patent and is directed toward a collapsible hammock which is of a quite simple, lightweight construction, and is easy to use and easy to transport.

As will become more apparent from the discussion that follows, the apparatus of the present invention embodies mounting brackets of a novel, lightweight construction to which both the hammock support uprights and the ground-engaging, stabilizing members are pivotally interconnected. The mounting brackets also carry novel, easy-to-use locking means for locking the uprights securely in their operating position.

SUMMARY OF THE INVENTION

It is an object of the present invention to provide an improved, lightweight, collapsible, fully portable hammock assembly in which the supporting framework includes novel mounting brackets to which the pivotally movable structural components of the apparatus are uniquely interconnected so that the device can be easily and quickly extended from a compact, collapsible configuration into a self-supporting structure which safely carries the supporting hammock.

Another object of the invention, is to provide an improved hammock construction of the aforementioned character in which the novel mounting brackets of the apparatus carry easy to use removable locking pins for securely locking the hammock support uprights in their operative position.

Another object of the invention is to provide an improved hammock construction of the type described in the preceding paragraph in which the novel mounting brackets also support ground engaging stabilizing members as well as biased detent means for constraining the stabilizing members in a stowed configuration when the apparatus is not in use.

Another object of the invention is to provide an improved collapsible hammock assembly of the aforementioned character which, when in its folded configuration, is mounted on a wheeled base assembly that permits easy transport of the collapsed apparatus from place to place.

Another object of the invention is to provide an improved, collapsible hammock assembly as described in the preceding paragraphs in which the framework, when extended for use, provides hammock support uprights to which the hammock can be easily interconnected so that the central portion of the hammock is elevated above the supporting surface a sufficient distance to permit flexing in a downward direction for increased comfort.

Still another object of the present invention is to provide an improved, collapsible hammock structure to which an ice chest can removably be affixed at a location where it is shaded by the hammock.

Another object of the invention is to provide an improved collapsible hammock structure to which a shade umbrella can be conveniently removably affixed.

Another object of the invention is to provide a collapsible, self-supporting, portable hammock assembly of the class described herein which is fabricated of readily commercially available metal tubular parts which are interconnected by easily fabricated mounting hardware so that the apparatus can be inexpensively produced.

DESCRIPTION OF THE INVENTION

Figures 4, 10:
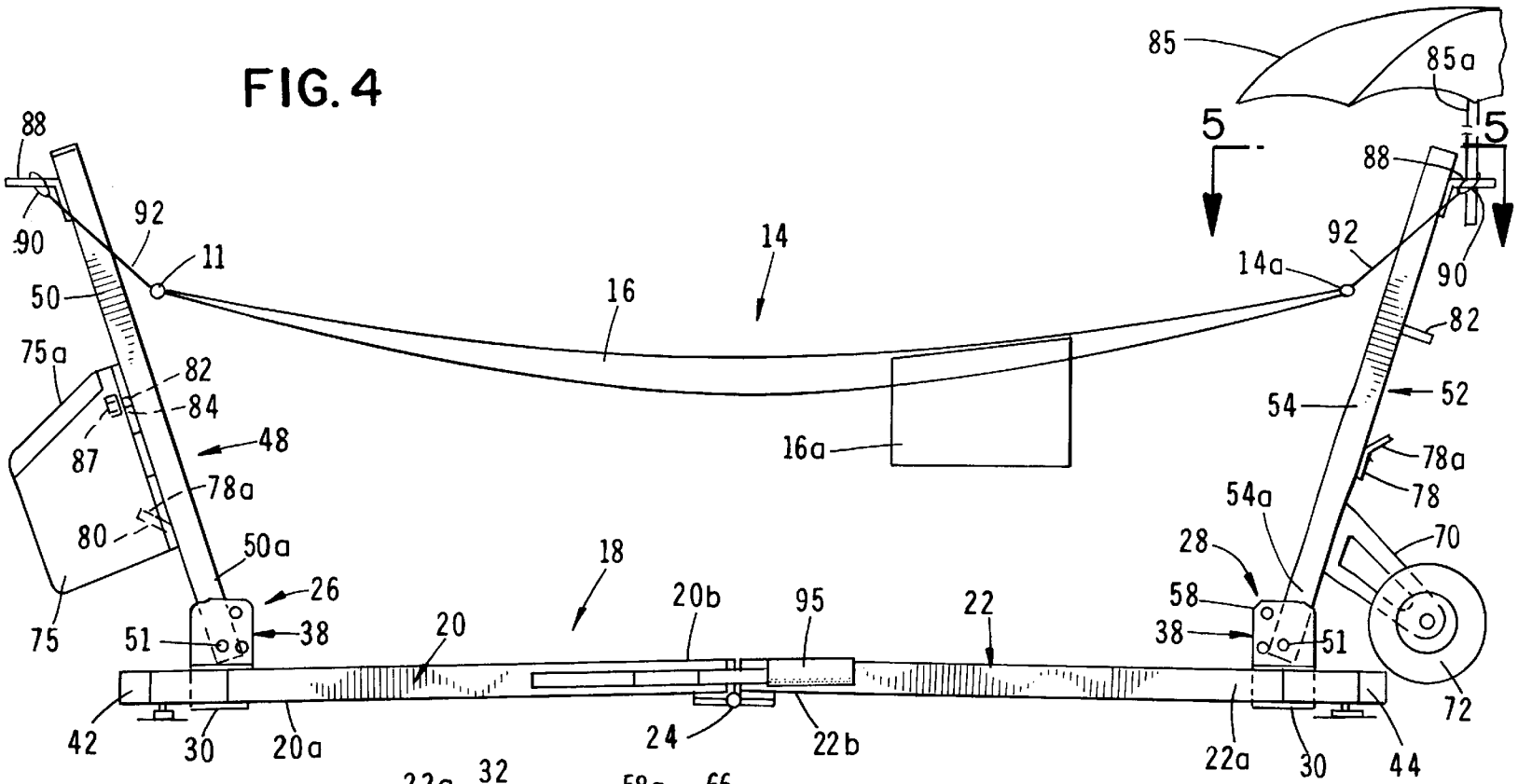
FIG. 4 is a side-elevational view of one form of the improved collapsible hammock assembly as it appears in its operational configuration.
FIG. 10 is an enlarged, cross-sectional view taken along lines 10—10 of FIG. 8.
Figure 11A:
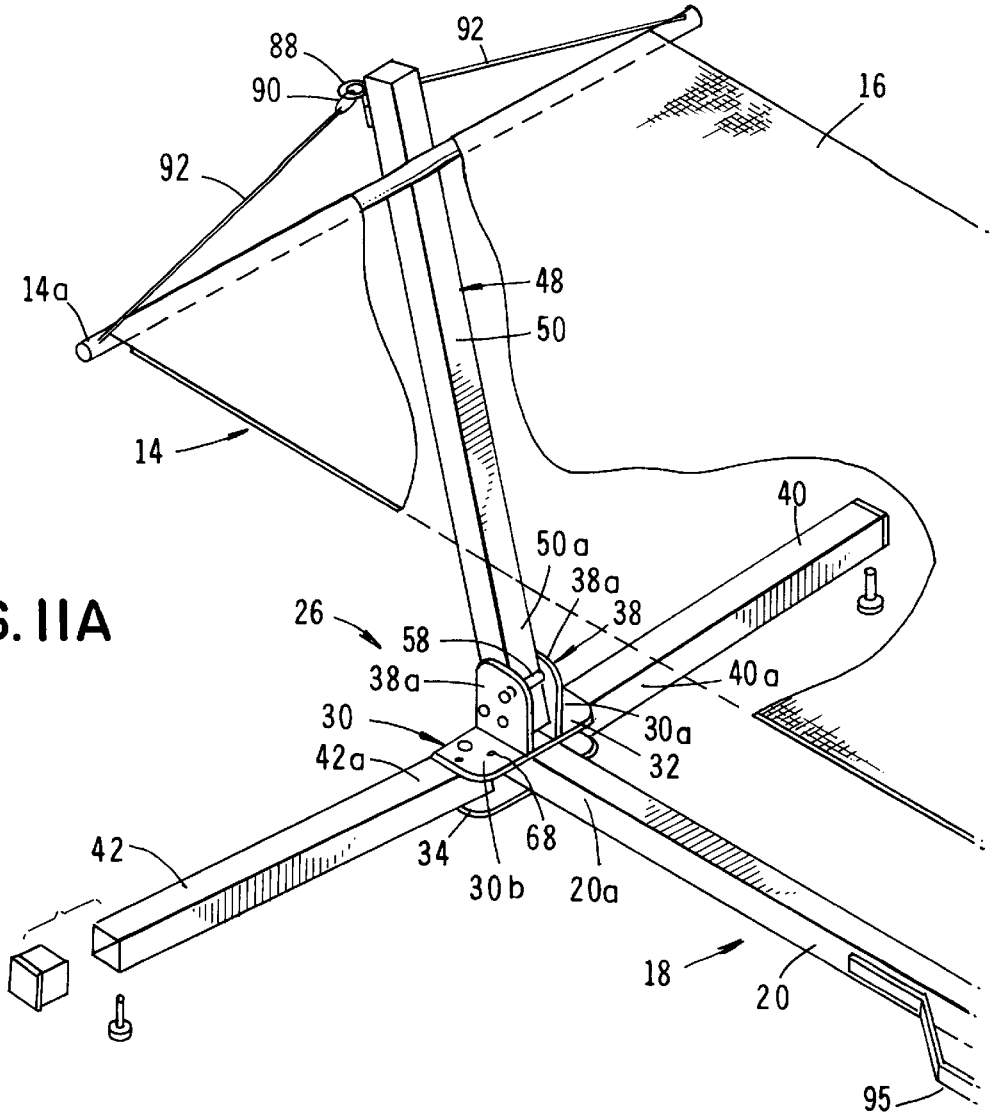
FIG. 11A and 11B when taken together comprise a generally perspective view of the fully assembled, improved collapsible hammock assembly of the invention shown in its operative configuration.
Figure 11B:
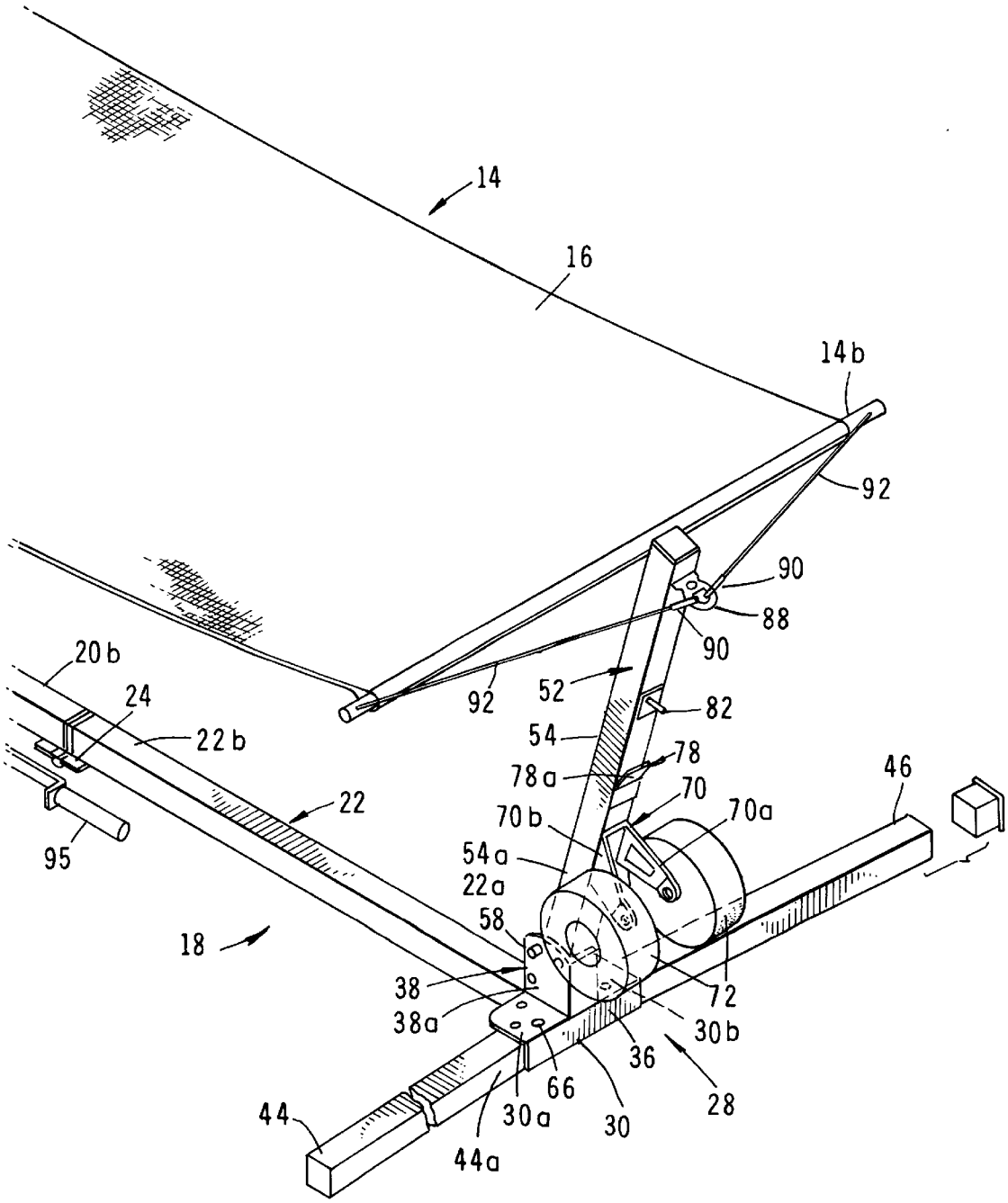

Referring to the drawings and particularly to FIGS. 4 and 11A and 11B, one form of the improved collapsible hammock assembly of the present invention is there shown in a fully assembled, operable configuration. In the form of the invention shown in the drawings, the apparatus includes two major components, namely a hammock assembly 14, which includes a flexible body support panel 16, and a foldable support frame 18 for supporting hammock assembly 14. As best seen in FIG. 11A and 11B, the support frame here comprises a first ground-engaging base member 20 having first and second ends 20*a* and 20*b*. A second ground-engaging base member 22 is hingeably interconnected with base member 20 in the manner shown in FIGS. 4 and 11B. Base member 22 also includes a first end portion 22*a* and a second end portion 22*b* to which one leaf of a hinge mechanism 24 is connected (FIG. 4). The second leaf of the hinge mechanism 24 is connected to base member 20 in the manner best seen in FIGS. 4 and 11.

Figure 1:
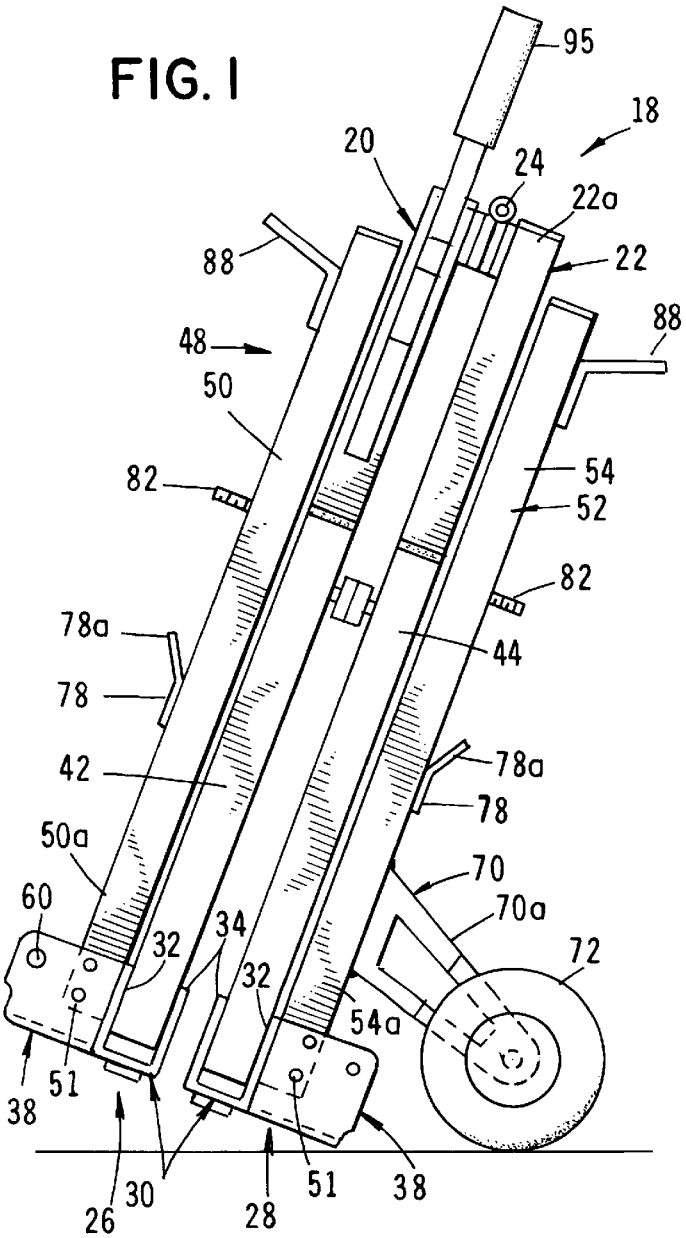
FIG. 1 is a side-elevational view of the improved collapsible hammock assembly of the invention shown in a collapsed, transport configuration.
Figure 2:
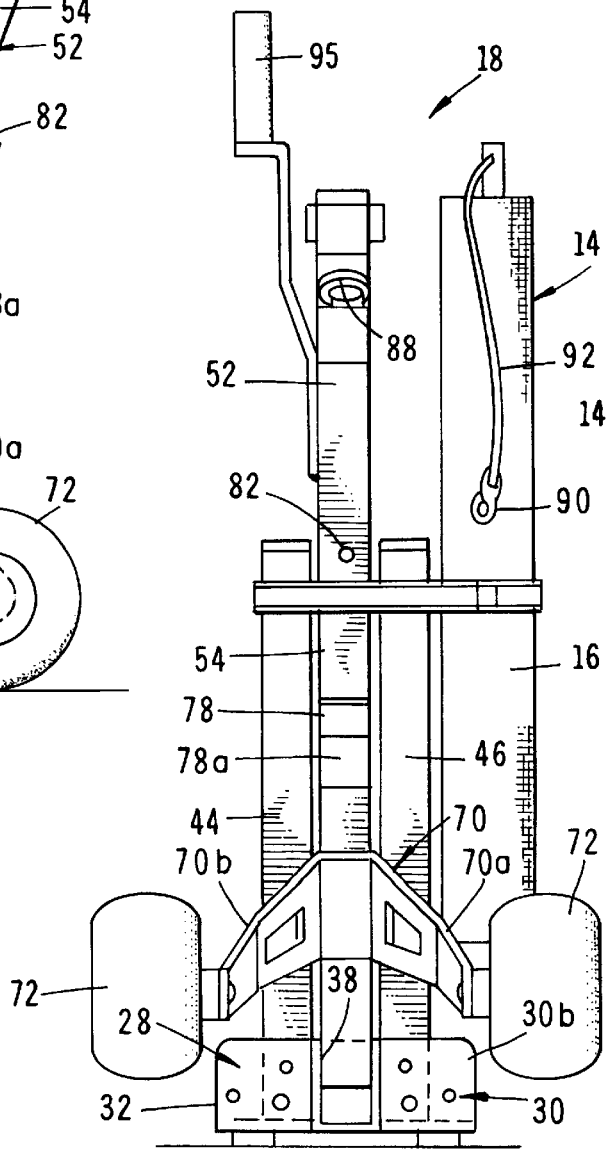
FIG. 2 is a front elevational view of the hammock assembly shown in FIG. 1.
Figures 3, 8, 9:
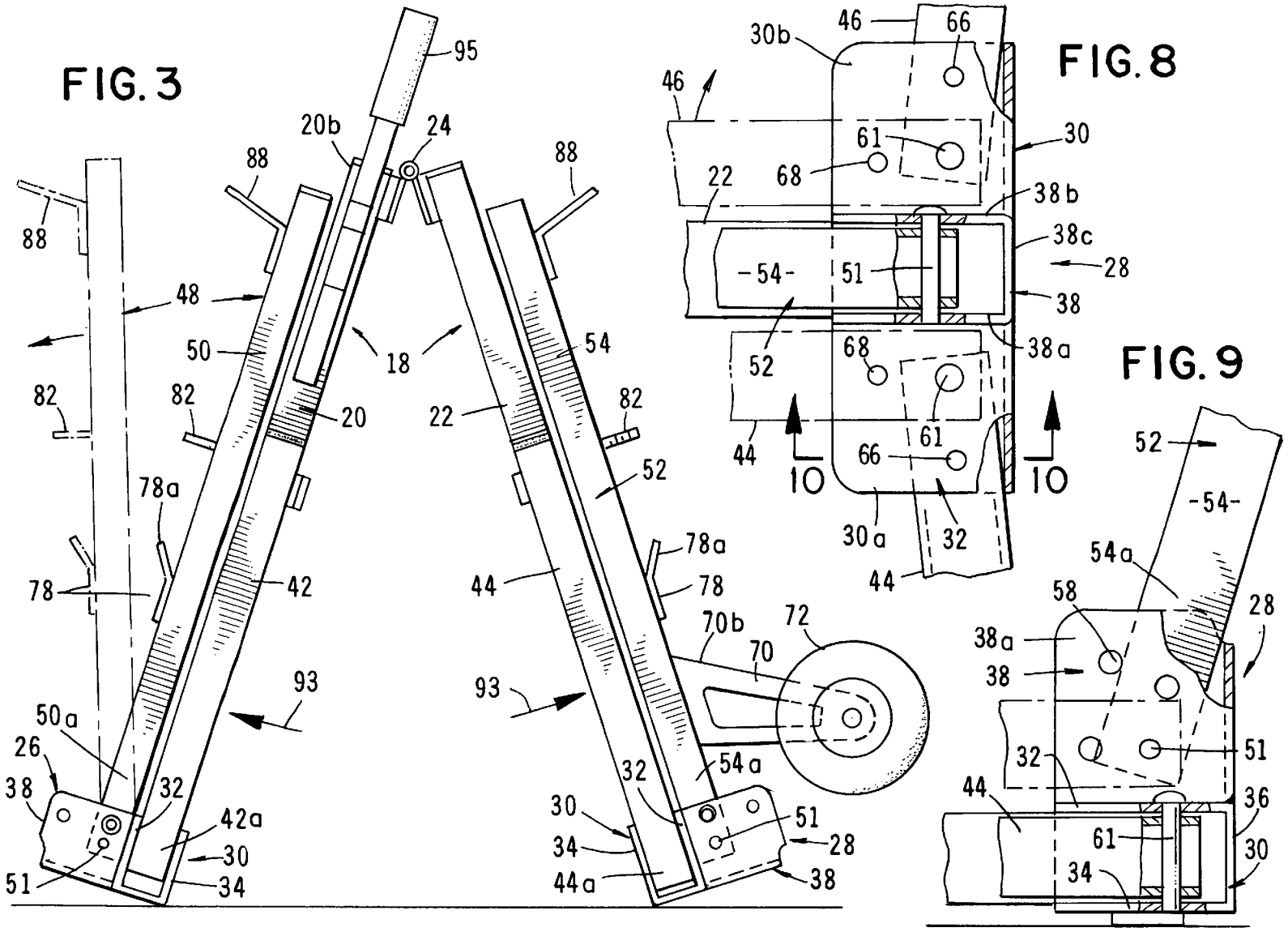
FIG. 3 is a side-elevational, diagrammatic view illustrating the manner in which the improved hammock assembly is moved from the collapsed transport configuration shown in FIGS. 1 and 2 toward the operative position of the assembly shown in FIG. 4.
FIG. 8 is an enlarged, fragmentary, top view partly in cross section of one of the mounting brackets of the invention showing one pair of the ground-engaging, stabilizing arms which arms are and one of the support arms pivotally connected to the mounting bracket.
FIG. 9 is a fragmentary, side-elevational view partly in cross section showing the manner in which the support arm of the apparatus is pivotally movable relative to the mounting bracket.

Base members 20 and 22 are movable from a first collapsed position shown in FIGS. 1 and 2 to the second longitudinally extended substantially in-line position shown in FIGS. 4 and 11A and 11B (see also FIG. 3). Forming an important aspect of the apparatus of the invention are the first and second mounting brackets which are of the novel configuration best seen in FIG. 6. As shown in FIGS. 11A and 11B, a first mounting bracket 26 is connected to base member 20 proximate end 20*a* thereof and a second mounting bracket 28 is connected to base member 22 proximate end 22*a* thereof. Mounting brackets 26 and 28 are of identical construction and reference should be made to FIG. 6 for an illustration of the construction of each of these novel mounting brackets.

Figure 6:
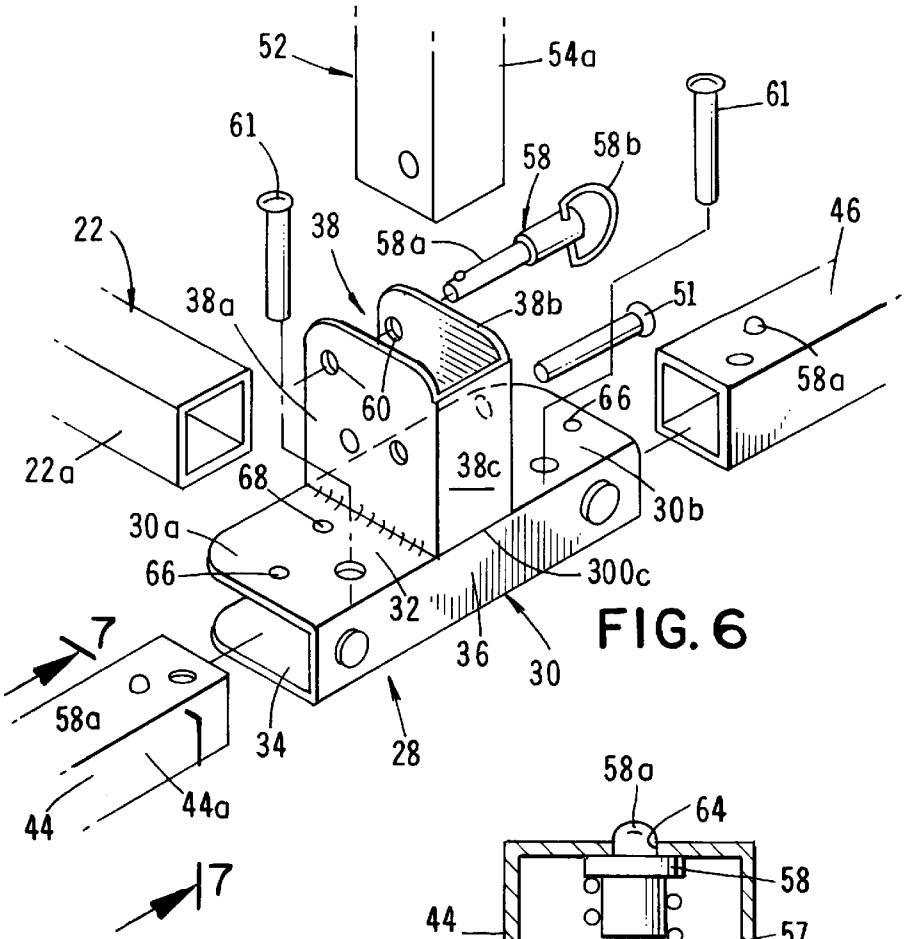
FIG. 6 is a greatly enlarged, generally perspective, exploded view of one of the two mounting brackets of the apparatus which are used to mount the transversely extending stabilizing arms of the apparatus as well as the upstanding hammock support arms of the apparatus.

Turning particularly to FIG. 6, it can be seen that each of the mounting brackets 26 and 28 comprises a transversely extending portion 30 having first and second end portions 30*a* and 30*b* and an intermediate portion 30*c*. Transversely extending portion 30 is generally U-shaped in cross section and has a top wall 32, a bottom wall 34 and a bight portion 36. Also forming a part of each mounting bracket 30, is a generally vertically extending portion 38 which is interconnected to intermediate portion 30*c* of transversely extending portion 30. Vertically extending portion 38 is also generally U-shaped in cross section and has spaced apart side walls 38*a* and 38*b* which are interconnected by a bight portion 38*c*.

Turning once again to FIGS. 11A and 11B, the first inboard end portion 40*a* of a first ground-engaging leg 40 is pivotally interconnected to portion 30*a* of bracket 26 and is disposed intermediate top and bottom walls 32 and 34 thereof. Similarly, the inboard end portion 42*a* of a second ground-engaging leg 42 is pivotally connected to portion 30*b* of bracket 26 and is disposed between the top and bottom walls 32 and 34 of the bracket. As indicated in FIG. 11B, a third ground-engaging leg 44 has an inboard end portion 44*a* which is pivotally interconnected with portion 30*a* of bracket 28. Similarly, a fourth ground-engaging leg 46 is pivotally interconnected with portion 30*b* of bracket 28 and is disposed between top and bottom walls 32 and 34 (see also FIG. 6).

Pivotally interconnected with bracket 26 is a first hammock support assembly 48 which functions to support a first end 14*a* of hammock assembly 14 (FIG. 11A). Support assembly 48 includes a first support arm 50 having an end portion 50*a* which is received between and pivotally connected to side walls 38*a* and 38*b* of support bracket 26. As illustrated in FIGS. 3, 8 and 9 support arm 50 is pivotally movable about a pivot pin 51 from a first, collapsed position shown by the solid lines in FIG. 3 to a second, angularly upwardly extending support position shown in FIG. 9. In similar fashion, a second hammock support assembly 52 for supporting second end portion 14*b* of hammock assembly 14 is pivotally interconnected with bracket assembly 28 (FIG. 11B). Second hammock support assembly 52 comprises a second support arm 54 having a lower end portion 54*a* which is receivable between and is pivotally connected to side walls 38*a* and 38*b* of the bracket assembly 28 by a pivot pin 51. Support arm 54 is also movable from the collapsed or stowed position shown in FIG. 3 to the operative position shown in FIG. 11B wherein the support arm extends angularly upwardly relative to base member 22.

First and second locking means of identical construction are operably associated with the vertically extending portions 38 of each of the brackets 26 and 28. These locking means function to maintain arms 50 and 52 in their upright, operable configuration as shown in FIG. 11A and 11B. Each of these locking means comprises a locking pin 58 which is of the character best seen in FIG. 6. Referring to FIG. 6, it is to be noted that each of the locking pins 58 have a shank portion 58*a* and a head portion 58*b*. Shank portion 58*a* of each of the locking pins is receivable within aligned apertures 60 provided in side walls 38*a* and 38*b* of upstanding portion 38 of each of the support brackets 26 and 28. When the support arms 50 and 54 are in their upright position, shank portions 58*a* of the locking pins are inserted into apertures 60 in the manner shown in FIG. 11A and 11B. In this position pins 58 reside in front of the upright support arms and function to resist forces imposed on support arms tending to move them from the upright position shown in FIG. 11A and 11B into the collapsed position shown in FIGS. 1, 2, and 3. When it is desired to move the apparatus of the invention into the stowed transport configuration shown in FIGS. 1 and 2, pins 58 can be easily removed from apertures 60 so as to enable free pivotal movement of support arms 50 and 54 into their stowed position where they reside in close proximity with ground-engaging base members 20 and 22 (see also FIG. 9).

Figure 7:
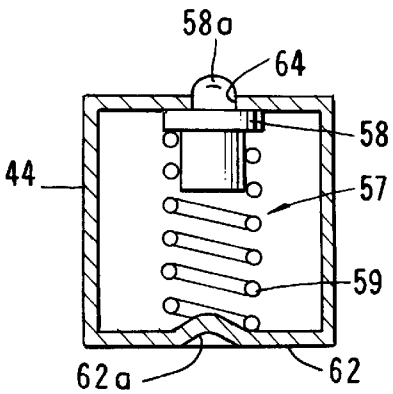
FIG. 7 is a greatly enlarged, cross-sectional view taken along lines 7—7 of FIG. 6 showing the spring loaded detent mechanism of the invention for resisting pivotal movement of the ground-engaging, stabilizing arms.
Figure 5:
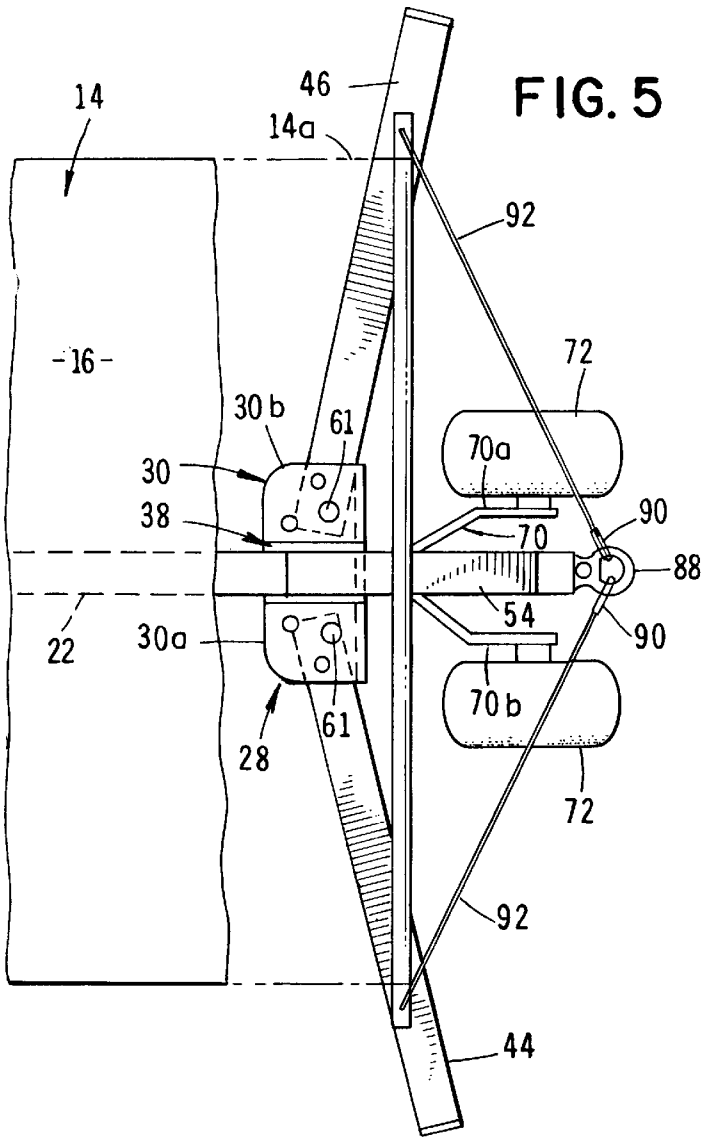
FIG. 5 is a greatly enlarged view taken along lines 5—5 of FIG. 4.

As illustrated in FIGS. 5 and 8, when the apparatus of the invention is moved from the stowed configuration shown in FIGS. 1 and 2 into the operable configuration shown in FIGS. 4 and 11A and 11B, two sets of stabilizing arms are then swung outwardly about pivot pins 61 from a position wherein they reside in close proximity with base members 20 and 22 into the transversely extending, operable positions shown in FIG. 11A and 11B. In their operable position, these stabilizing members 40, 42, 44 and 46 extend angularly outwardly from base members 20 and 22 in the manner shown in FIGS. 11A and 11B. To resist pivotal movement of the stabilizing members from the stowed position to the operative position, securement means are operably associated with each of the stabilizing members 40, 42, 44 and 46. These securement means are of identical construction and as best seen in FIG. 7 each comprise a conventional detent mechanism 57 having head portion 58 including a rounded detent head 58*a* and a coil spring 60 which is disposed between detent head assembly 58 and the bottom wall 62 of each of the ground-engaging base members 40, 42, 44 and 46. As shown in FIGS. 7 and 10, bottom walls 62 are provided with dimple-like portions 62*a* which hold the spring in position. With the construction thus described, springs 60 continuously urge detent heads 58 outwardly to apertures 64 provided in each of the ground-engaging stabilizing members. When the ground-engaging legs are pivoted into the outwardly extending position shown in FIGS. 11A and 11B, detent heads 58*a* are releasably received within strategically located apertures 66 provided in top walls 32 of brackets 26 and 28. In this position, the detent mechanisms functions to resist pivotal movement of the supporting legs from the extended position into the collapsed stowed position. It is also to be noted that each of the top walls 32 of the brackets 26 and 28 are provided with a second detent receiving aperture 68. Apertures 68 are strategically located so as to receive detent heads 58 of the detent mechanisms when the ground-engaging stabilizing legs are in the stowed position shown in FIGS. 1 and 2. In this position, the detent mechanisms function to resist pivotal movement of the legs from the stowed position into the operable position and in this way prevent accidental deployment of the stabilizing members.

In order to enable easy transport of the apparatus of the invention when it is in its folded or stowed configuration, wheel means are provided. These wheel means here comprise a yoke-like member 70 which is connected to support arm 54. Yoke-like member 70 includes spaced-apart arms 70*a* and 70*b* to which wheels 72 are rotatably connected. Wheels 72 are arranged so that as the aperture is tilted forwardly in the manner shown in FIG. 1, they will rotatably engage the ground or other rolling surface upon which the apparatus is to be rolled during transport.

Another important feature of the apparatus of the present invention comprises ice chest mounting means connected to both the first and second support arms 50 and 54. These means function to removably support an ice chest of the character generally designated in FIG. 4 by the numeral 75. In the form of the invention shown in the drawings, the ice chest mounting means comprises brackets 78 having angularly upwardly extending fingers 78*a* which are receivable within a socket 80 provided in the lower portion of the ice chest 75. The ice chest mounting means also include an outwardly extending threaded connector 82 which is receivable within an opening 84 provided proximate the upper portion of the ice chest 75. With this construction, the ice chest 75 can be conveniently mounted on a selected one of the support arms 50 or 54 by inserting fingers 78*a* into the socket 80 provided in the wall of the ice chest. The ice chest can then be tilted upwardly so that connector 82 is received within opening 64. By opening lid 75*a* of the ice chest, a nut can be connected to threaded connector 82 to secure the ice chest in position. If it is desired, to protect the ice chest from overhead sun, the ice chest can be positioned on the supporting arm to which an umbrella assembly 85 is interconnected in the manner shown in FIG. 4. If, on the other hand, the sun is not overhead, the ice chest can be positioned on a selected one of the upstanding support arms which will position the ice chest at a location where it is shaded from the sun by support panel 16.

Provided proximate the upper end of each of the support arms 50 and 52 is a ring-like connector member 88. Ring-like members 88 function to hold the previously identified umbrella assembly 85 and in position as shown in FIG. 4 also function to receive hook-like connector elements 90 (FIG. 2) which are provided proximate the free ends of two pair of connector cables 92 which form a part of the support arm connector means of the invention. Connector cables 92, are secured at each of the ends 14*a* and 14*b* of the hammock assembly 14 so that connector elements 90 can be removably interconnected with the connector rings 88 in the manner shown in FIGS. 11A and 11B to securely support the hammock assembly in an operable configuration.

In using the apparatus of the invention, ground-engaging members 20 and 22 are first unfolded from their stowed position in the manner shown by the arrows 93 of FIG. 3. To assist in this unfolding step and to conveniently lower the base engaging members into a substantially in-line horizontal ground-engaging position as shown in FIG. 4, an outwardly extending gripping handle 95 is provided. Handle 95 is interconnected with ground-engaging base member 20 in the manner best seen in FIGS. 1 and 2 (see also FIG. 4). With base engaging members 20 and 22 in the lowered, in-line configuration shown in FIG. 4, members 50 and 54 can then be pivoted into their upright position in the manner illustrated in FIGS. 3 and 9. After support arms 50 and 54 have been pivoted into their operative position about pivot pins 51, locking pins 58 can be interconnected with the support brackets in the manner previously described to secure the support arms in the operable configuration and to positively prevent downward pivotal movement of support arms in a direction toward their collapsed position. Next, the transversely extending ground-engaging, stabilizing members 40, 42, 44 and 46 can swing outwardly about pivot pins 61 and into their operative position shown in FIGS. 11A and 11B. As previously mentioned, the securement means or detent mechanisms 57, function to yieldably resist pivotal movement of the ground-engaging support arms from their stowed position into their operative position and also function to yieldably prevent accidental movement of the arms from their operative position back into the stowed position.

With the supporting frame in its operative position, the flexible body support panel 16 of the hammock assembly can be unrolled to expose connector cables 92 and hook-like connector elements 90. With this support panel 16 unfurled, connector elements 90 of one end of the hammock assembly can be interconnected with one of the rings 88 provided on the upwardly extending support arms 50 and 54. This done, the connector elements 90 provided on the connector cables disposed at the opposite end of the support panel can be similarly affixed to the ring 88 provided on the oppositely disposed support arm. Once the hammock assembly has been thus interconnected with the support arms 50 and 54, the apparatus is ready for use. When desired umbrella assembly 85 can be affixed to a selected one of the ring-like members 88 by inserting the handle portion 85*a* thereof into the ring connector 88 so as to support the umbrella in the upright position shown in FIG. 4. Similarly, if desired ice chest 75 can be suitably affixed to a selected one of the support arms 50 or 54 in the manner previously discussed. As best seen in FIG. 4, a downwardly depending pocket-like member 16*a* is affixed to at least one side of panel 16 to carry various articles such as books, lotion and the like.

Having now described the invention in detail in accordance with the requirements of the patent statutes, those skilled in this art will have no difficulty in making changes and modifications to the individual parts or their relative assembly in order to meet specific requirements or conditions. Such changes and modifications may be made without departing from the scope and spirit of the invention, as set forth in the following claims.

I claim:

1. An improved collapsible hammock assembly comprising:

(a) a foldable support frame including first and second hingeably interconnected base assemblies movable from a first transport position to a second support position, each said base assembly comprising:

(i) a base member;

(ii) a mounting bracket connected to said base member, said mounting bracket comprising:

a. a transversely extending, ground engaging portion having first and second end portions and an intermediate portion, said transversely extending portion having a top wall, a bottom wall and a bight portion interconnecting said top and bottom walls; and b. a generally vertically extending portion connected to said intermediate portion of said transversely extending ground engaging portion, said vertically extending portion having spaced-apart, generally vertically extending side walls and a bight portion interconnecting said side walls, said side walls and said bight portion being substantially perpendicular to said top wall of said transversely extending sound engaging portion;

(iii) a first ground engaging leg having an end portion received between and pivotally connected to said top and bottom walls of said first bracket;

(iv) a second ground engaging leg having an end portion received between and pivotally connected to said top and bottom walls of said first bracket;

(v) support arm having an upper end portion and a lower end portion received between and pivotally connected to said generally vertically extending side walls of said first bracket for movement between a collapsed position and an operative position; and (vi) locking means operably associated with said generally vertically extending portion of said mounting bracket for locking said support arm in said operative position; and (b) a hammock assembly removably connected to said support arms of said base assemblies.

2. An assembly as defined in claim 1 in which each said base assembly further securement means operably associated with said mounting bracket for yieldably resisting pivotal movement of said first and second ground engaging legs.

3. An assembly as defined in claim 1 in which one of said first and second base assemblies further includes a pair of wheels rotatably connected to said support arm thereof.

4. An assembly as defined in claim 1 in which one of said first and second base assemblies further includes an ice chest removably connected to said support arm thereof.

5. An assembly as defined in claim 1 in which one of said first and second base assemblies further includes an umbrella assembly connected to said support arm thereof.

6. An assembly as defined in claim 1 in which one of said first and second base assemblies further includes an outwardly extending gripping handle connected to said base member thereof.

7. An assembly as defined in claim 1 in which said hammock assembly comprises:

(a) a flexible body support panel having first and second ends; and (b) support arm connector means provided at each of said first and second ends of said body support panel for removably interconnecting said body support with said support arms of said first and second base assemblies.

8. An assembly as defined in claim 7 in which said support arm connector means comprises first and second connector lengths each said connector length having a connector element connected thereto.

9. An assembly as defined in claim 8 in which each of said support arms of said first and second base assemblies is provided with a connector ring for interconnection with said connector elements of said support arm connector means.

10. An improved collapsible hammock assembly comprising;

(a) a hammock assembly, including a flexible body support panel having first and second ends;

(b) a foldable support frame for supporting said hammock assembly, said support frame comprising;

(i) a first base member having first and second ends;

(ii) a second base member having first and second ends, said second end of said second base member being hingeably connected to said second end of said first base member, said first and second base members being movable from a first collapsed position to a second, longitudinally extending, position;

(iii) a first mounting bracket connected to said first base member and a second mounting bracket connected to said second base member each said first and second mounting brackets comprising:

a. a transversely extending, ground engaging portion having first and second end portions and an intermediate portion, said transversly extending portion having a top wall, a bottom wall and a bight portion interconnecting said top and bottom walls; and b. a generally vertically extending portion connected to said intermediate portion of said transversely extending ground engaging portion, said vertically extending portion having spaced-apart, generally vertically extending side walls and a bight portion interconnecting said side walls, said side walls and said bight portion being substantially perpendicular to said top wall of said transversely extending ground engaging portion;

(iv) a first ground engaging leg having an end portion received between and pivotally connected to said top and bottom walls of said first mounting bracket;

(v) a second ground engaging leg having an end portion received between and pivotally connected to said top and bottom walls of said first mounting bracket;

(vi) a third ground engaging leg having an end portion received between and pivotally connected to said top and bottom walls of said second mounting bracket;

(vii) a fourth ground engaging leg having and end portion received between and pivotally connected to said top and bottom walls of said second mounting bracket;

(viii) a first hammock support assembly for supporting said first end of said hammock, said assembly comprising a first support arm having an end portion received between and pivotally connected to said side walls of said first mounting bracket for movement between a collapsed position and an operative position, (ix) a second hammock support assembly for supporting said second end of said hammock, said assembly comprising a second support arm having an end portion received between and pivotally connected to said side walls of said second mounting bracket for movement between a collapsed position to an operative position;

(x) first locking means operably associated with said generally vertically extending portion of said first mounting bracket for locking said first support arm in said operative position; and (xi) second locking means operably associated with said generally vertically extending portion of said second mounting bracket for locking said second support arm in said operative position.

11. An assembly as defined in claim 10 further including first securement means operably associated with said first mounting bracket for yieldably resisting pivotal movement of said first and second ground engaging legs relative to said first mounting bracket.

12. An assembly as defined in claim 11 further including second securement means operably associated with said second mounting bracket for yieldably resisting pivotal movement of said third and fourth ground engaging legs relative to said second mounting bracket.

13. An improved collapsible hammock assembly comprising:

(a) a hammock assembly, including a flexible body support panel having first and second ends;

(b) a foldable support frame for supporting said hammock assembly, said support frame comprising:

(i) a first base member having first and second ends;

(ii) a second base member having first and second ends, said second end of said second base member being hingeably connected to said second end of said first base member, said first and second base members being movable from a first collapsed position to a second, longitudinally extending, substantially in-line position;

(iii) a first mounting bracket connected to said first base member and a second mounting bracket connected to said second base member each said first and second mounting brackets comprising:

a. a transversely extending, ground engaging portion having first and second end portions and an intermediate portion, said transversely extending portion being generally "U" shaped in cross section; and b. a generally vertically extending portion connected to said intermediate portion of said transversely extending ground engaging portion, said vertically extending portion being generally "U" shaped in cross section;

(iv) first securement means operably associated with said first mounting bracket for yieldably resisting pivotal movement of said first and second ground engaging legs relative to said first mounting bracket;

(v) second securement means operably associated with said second mounting bracket for yieldably resisting pivotal movement of said third and fourth ground engaging legs relative to said first mounting bracket;

(vi) a first ground engaging leg having an end portion received within and pivotally connected to said first end portion of said first mounting bracket;

(vii) a second ground engaging leg having an end portion received within and pivotally connected to said second end portion of said first mounting bracket;

(viii) a third ground engaging leg having an end portion received within and pivotally connected to said first end portion of said second mounting bracket;

(ix) a fourth ground engaging leg having an end portion received within and pivotally connected to said second end portion of said second mounting bracket;

(x) a first hammock support assembly for supporting said first end of said hammock, said assembly comprises a first support am having an end portion received within and pivotally connected to said generally vertically extending portion of said first mounting bracket for movement between a collapsed position and an operative position;

(xi) a second hammock support assembly for supporting said second end of said hammock, said assembly comprising a second support arm having an end portion received within and pivotally connected to said generally vertically extending portion of said second mounting bracket for movement between a collapsed position to an operative position;

(xii) first locking means operably associated with said generally vertically extending portion of said first mounting bracket for locking said first support arm in said operative position, said first locking means comprising a first locking pin removably connected to said generally vertically extending portion of said first mounting bracket; and (xiii) second locking means operably associated with said generally vertically extending portion of said second mounting bracket for locking said second support arm in said operative position; said second locking means comprising a second locking pin removably connected to said generally vertically extending portion of said second mounting bracket.

14. An improved collapsible hammock assembly comprising:

(a) a hammock assembly, including a flexible body support panel having first and second ends;

(b) a foldable support frame for supporting said hammock assembly, said support frame comprising:

(i) a first base member having first and second ends;

(ii) a second base member having first and second ends, said second end of said second base member being hingeably connected to said second end of said first base member, said first and second base members being movable from a first collapsed position to a second, longitudinally extending, substantially in-line position;

(iii) a first mounting bracket connected to said first base member and a second mounting bracket connected to said second base member each said first and second mounting brackets comprising:

a. a transversely extending, ground engaging portion having first and second end portions and an intermediate portion, said transversely extending portion being generally "U" shaped in cross section; and b. a generally vertically extending portion connected to said intermediate portion of said transversely extending ground engaging portion, said vertically extending portion being generally "U" shaped in cross section;

(iv) first securement means operably associated with said first mounting bracket for yieldably resisting pivotal movement of said first and second ground engaging legs relative to said first mounting bracket, said first securement means comprising a detent mechanism including a rounded detent head and a coiled spring connected to said detent head for urging said detent head in a first direction;

(v) second securement means operably associated with said second mounting bracket for yieldably resisting pivotal movement of said third and fourth ground engaging legs relative to said first mounting bracket, said second securement means comprising a detent mechanism including a rounded detent head and a coiled spring connected to said detent head for urging said detent head in a first direction;

(vi) a first ground engaging leg having an end portion received within and pivotally connected to said first end portion of said first mounting bracket;

(vii) a second ground engaging leg having an end portion received within and pivotally connected to said second end portion of said first mounting bracket;

(viii) a third ground engaging leg having an end portion received within and pivotally connected to said first end portion of said second mounting bracket;

(ix) a fourth ground engaging leg having an end portion received within and pivotally connected to said second end portion of said second mounting bracket;

(x) a first hammock support assembly for supporting said first end of said hammock, said assembly comprises a first support am having an end portion received within and pivotally connected to said generally vertically extending portion of said first mounting bracket for movement between a collapsed position and an operative position;

(xi) a second hammock support assembly for supporting said second end of said hammock, said assembly comprising a second support arm having an end portion received within and pivotally connected to said generally vertically extending portion of said second mounting bracket for movement between a collapsed position to an operative position;

(xii) first locking means operably associated with said generally vertically extending portion of said first mounting bracket for locking said first support arm in said operative position; and (xiii) second locking means operably associated with said generally vertically extending portion of said second mounting bracket for locking said second support arm in said operative position.

15. An assembly as defined in claim 14 in which said second hammock support assembly further includes a yoke member connected to said second support and a pair of wheels rotatably connected to said yoke-like member.

16. An improved collapsible hammock assembly comprising:

(a) a hammock assembly including a flexible body support panel having first and second ends; and (b) a foldable support frame for supporting said hammock assembly, said support frame comprising:

(i) a first ground engaging base member having first and second ends;

(ii) a second ground engaging base member having first and second ends, said second end of said second ground engaging base member being hingeably connected to said second end of said first ground engaging base member, said first and second ground engaging base members being movable from a first collapsed position to a second, longitudinally extending, substantially in-line position;

(iii) a first mounting bracket connected to said first base member and a second mounting bracket connected to said second base member each said first and second mounting brackets comprising:

a. a transversely extending portion having first and second end portions and an intermediate portion, said transversely extending portion being generally "U" shaped in cross section and having a top wall, a bottom wall, and a bight portion; and b. a generally vertically extending portion connected to said intermediate portion of said transversely extending ground engaging portion, said vertically extending portion being generally "U" shaped in cross section and having spaced-apart side walls and a bight portion, said side walls being connected to said top wall of said transversely extending portion;

(iv) a first ground engaging leg having an end portion received between said top and bottom walls of said first end portion of said transversely extending portion of said first mounting bracket and being pivotally connected to said first end portion;

(v) a second ground engaging leg having an end portion received within said top and bottom walls of said second end portion of said transversely extending portion of said first mounting bracket and being pivotally connected to said second end portion;

(vi) a third ground engaging leg having an end portion received between said top and bottom walls of said first end portion of said transversely extending portion of said second mounting bracket and being pivotally connected to said first end portion;

(vii) a fourth ground engaging leg having an end portion received between said top and bottom walls of said second end portion of transversely extending portion of said second mounting bracket and being pivotally connected to said second end portion;

(viii) a first hammock support assembly for supporting said first end of said hammock, said assembly comprising a first support arm having an end portion received between said side walls of said generally vertically extending portion of said first mounting bracket, said first support arm being pivotally connected to said vertically extending portion of said first mounting bracket for movement between a collapsed position and an operative position;

(ix) a second hammock support assembly for supporting said second end of said hammock, said assembly comprising a second support arm having an end portion received between said side walls of said generally vertically extending portion of said second mounting bracket, said second support arm being pivotally connected to said vertically extending portion of said second mounting bracket for movement between a collapsed position to an operative position;

(x) first locking means operably associated with said generally vertically extending portion of said first mounting bracket for locking said first support arm in said operative position, said first locking means comprising a first locking pin; and (xi) second locking means operably associated with said generally vertically extending portion of said second mounting bracket for locking said second support arm in said operative position, said second locking means comprising a second locking pin;

(xii) first securement means operably associated with said first mounting bracket for yieldably resisting pivotal movement of said first and second ground engaging legs relative to said first mounting bracket; and (xiii) second securement means operable associated with said second mounting bracket for yieldably resisting pivotal movement of said third and fourth ground engaging legs relative to said second mounting bracket.

17. An assembly as defined in claim 16 in which said second hammock support assembly further includes a yoke member connected to said second support and a pair of wheels rotatably connected to said yoke member.

18. An assembly as defined in claim 16 in which said second hammock support assembly further includes ice chest mounting bracket connected to said first support arm and an ice chest removably connected to said ice chest mounting bracket.

19. An assembly as defined in claim 16 in which said first hammock support assembly further includes an umbrella removably connected to a selected one of said support arms.

20. An assembly as defined in claim 16 further including an outwardly extending gripping handle connected to said first ground engaging base member.

* * * * *